US011291880B1

(12) United States Patent
Arizmendez

(10) Patent No.: US 11,291,880 B1
(45) Date of Patent: Apr. 5, 2022

(54) CRAWLING WORKOUT APPARATUS

(71) Applicant: Rueben Arizmendez, Pasadena, TX (US)

(72) Inventor: Rueben Arizmendez, Pasadena, TX (US)

( * ) Notice: Subject to any disclaimer, the term of this patent is extended or adjusted under 35 U.S.C. 154(b) by 69 days.

(21) Appl. No.: 17/032,029

(22) Filed: Sep. 25, 2020

(51) Int. Cl.
*A63B 21/00* (2006.01)

(52) U.S. Cl.
CPC ..... *A63B 21/4034* (2015.10); *A63B 21/4035* (2015.10); *A63B 21/4039* (2015.10); *A63B 21/4049* (2015.10)

(58) Field of Classification Search
CPC ..... A63B 21/4034; A63B 21/4035; A63B 21/4039; A63B 21/4049
See application file for complete search history.

(56) References Cited

U.S. PATENT DOCUMENTS 326,247 A 9/1885 Root
4,688,791 A 8/1987 Long
5,269,736 A 12/1993 Roberts
7,455,633 B2 11/2008 Brown
8,888,661 B2 11/2014 Ellis
D785,732 S 5/2017 Moschel
2021/0086025 A1* 3/2021 Carruthers ..... A63B 22/001
2021/0220696 A1* 7/2021 Carruthers ..... A63B 22/0046
2021/0387044 A1* 12/2021 Carruthers ..... A63B 21/00069
2021/0387045 A1* 12/2021 Carruthers ..... A63B 22/001

FOREIGN PATENT DOCUMENTS

WO WO2015138279 9/2015

* cited by examiner

*Primary Examiner* — Andrew S Lo

(57) ABSTRACT

A crawling workout apparatus for exercising the back and arms in a natural manner includes a base having a central base bar and a plurality of legs. A pair of crank shafts is rotatably coupled to a pedal support and a pair of pedals with handles is coupled to the pair of crank shafts. A pair of crossbars is coupled to the pair of pedals and arranged in an overlapping X-shape. A pair of leg bars is coupled to the pair of crossbars. A pair of kneepads coupled to the pair of leg bars and a pair of footrests is coupled to the pair of leg bars. A pair of support frames is coupled to a leg support. A pair of leg support rods is coupled to the pair of support frames and extends through a leg bar distal end of each leg bar.

10 Claims, 6 Drawing Sheets

CRAWLING WORKOUT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to workout devices and more particularly pertains to a new workout device for exercising the back and arms in a natural manner.

(2) Description of Related Art Including Information Disclosed Under 37 CFR 1.97 and 1.98

The prior art relates to workout devices. Known devices allow for upper body workouts using hand-operated pedals. These devices, however, do not put the user in an all fours or crawling position. These known devices also do not link the movement of the arms to movement of the legs in order to exercise the hips and back.

BRIEF SUMMARY OF THE INVENTION

An embodiment of the disclosure meets the needs presented above by generally comprising a base having a central base bar and a plurality of legs. A pedal support is coupled to the base. The pedal support extends perpendicularly from the central base bar proximal a head side of the base. A pair of crank shafts is coupled to the pedal support. Each crank shaft is rotatably coupled to the pedal support. A pair of pedals is coupled to the pair of crank shafts. Each pedal is rotatably coupled to the respective crank shaft. A pair of handles is coupled to the pair of pedals. A pair of crossbars is coupled to the pair of pedals. Each crossbar is pivotably coupled to the respective pedal and the pair of crossbars is arranged in an overlapping X-shape. A pair of leg bars is coupled to the pair of crossbars. Each leg bar is pivotably coupled to the respective crossbar. A pair of kneepads coupled to the pair of leg bars and a pair of footrests is coupled to the pair of leg bars. A leg support is coupled to the base. The leg support extends from the central base bar proximal a foot side of the base. A pair of support frames is coupled to the leg support. A pair of leg support rods is coupled to the pair of support frames. Each leg support rod extends through a leg bar distal end of the respective leg bar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
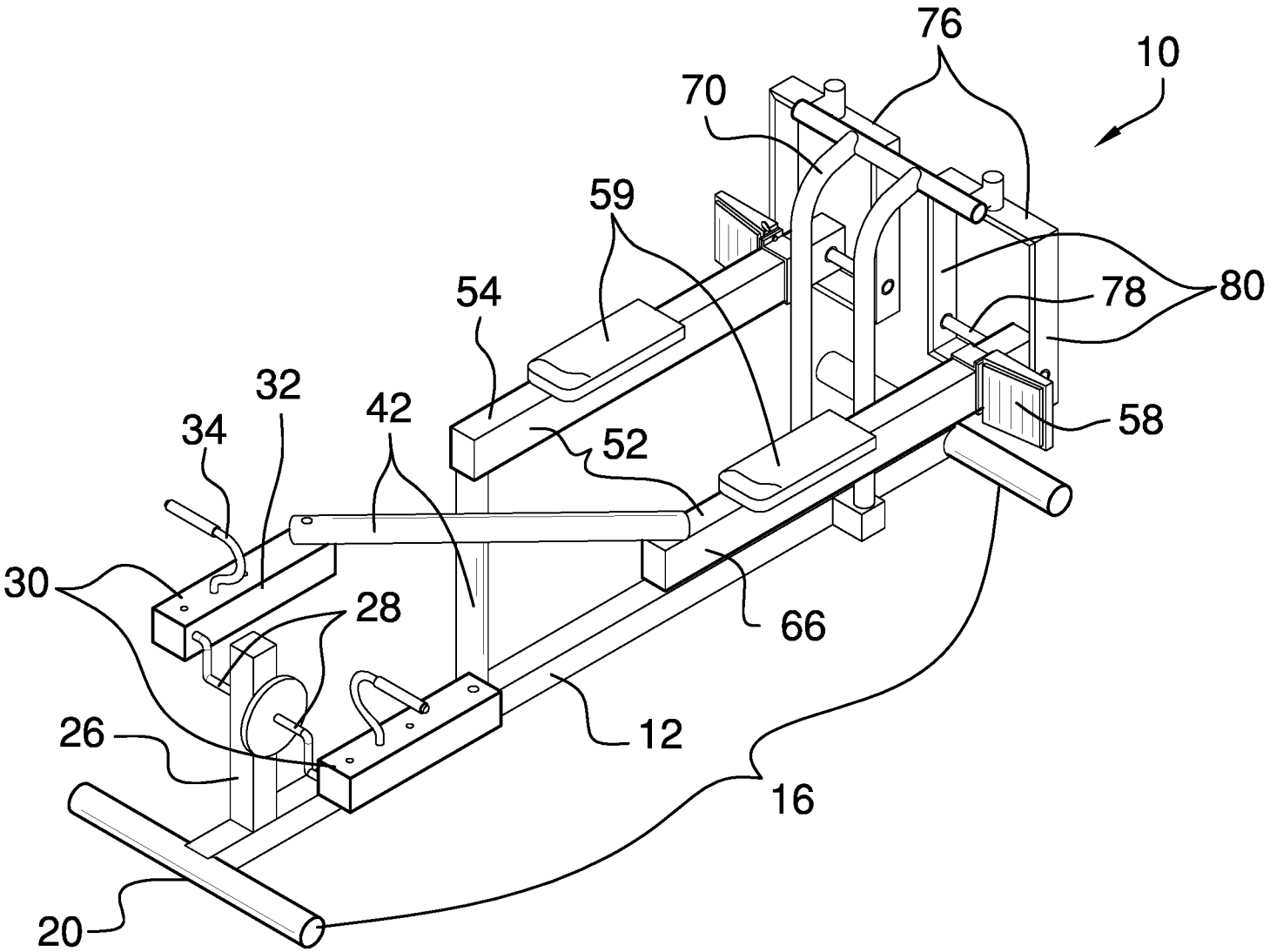
FIG. 1 is an isometric view of a crawling workout apparatus according to an embodiment of the disclosure.

With reference now to the drawings, and in particular to FIGS. 1 through 6 thereof, a new workout device embodying the principles and concepts of an embodiment of the disclosure and generally designated by the reference numeral 10 will be described.

As best illustrated in FIGS. 1 through 6, the crawling workout apparatus 10 generally comprises a base 12 having a central base bar 14 and a plurality of legs 16. The plurality of legs 16 of the base may include a front leg 18 coupled perpendicularly to the central base bar 14 at a head side 20 of the base and a back leg 22 coupled perpendicularly to the central base bar 14 at a foot side 24 of the base.

A pedal support 26 is coupled to the base 12. The pedal support 26 extends perpendicularly from the central base bar 14 proximal the head side 20 of the base. A pair of crank shafts 28 is coupled to the pedal support 26. Each crank shaft 28 is rotatably coupled to the pedal support 26. A pair of pedals 30 is coupled to the pair of crank shafts 28. Each pedal 30 is rotatably coupled to the respective crank shaft 28. Each pedal 30 may be rectangular prismatic with the crank shaft 28 coupled to a pedal inner side 32. A pair of handles 34 is coupled to the pair of pedals 30. Each handle 34 has a handle extension 36 extending up and out from a pedal top side 38 of the respective pedal and a grip 40 coupled to the handle extension 36.

A pair of crossbars 42 is coupled to the pair of pedals 30. Each crossbar 42 is pivotably coupled to the respective pedal 30 proximal a pedal backside 44 thereof. The pair of crossbars 42 is arranged in an overlapping X-shape and includes a top crossbar 46 coupled to a pedal top side 48 of one of the pedals 30 and a bottom crossbar 48 coupled to a pedal bottom side 50 of the other pedal 30.

Figure 2:
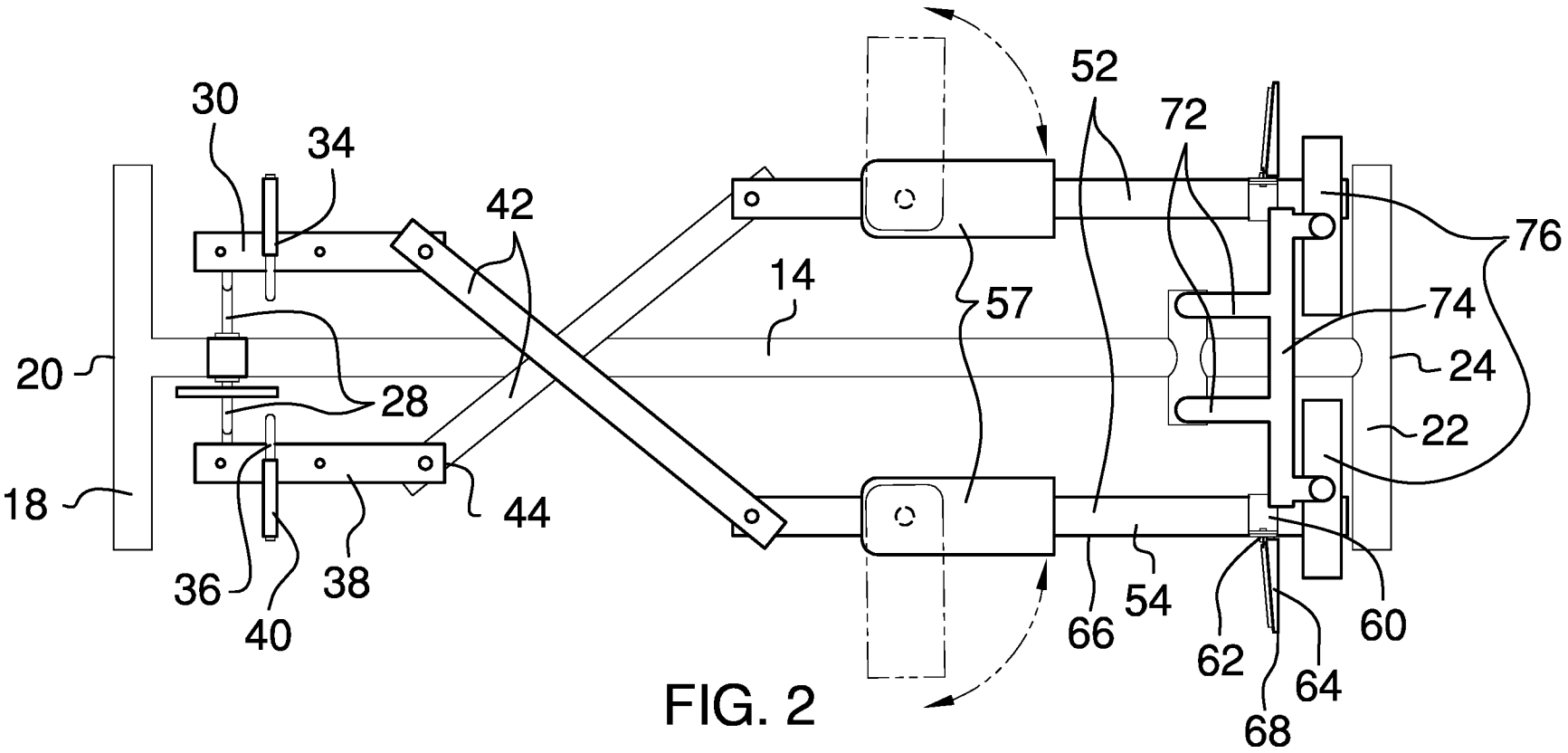
FIG. 2 is a top plan view of an embodiment of the disclosure.
Figure 3:
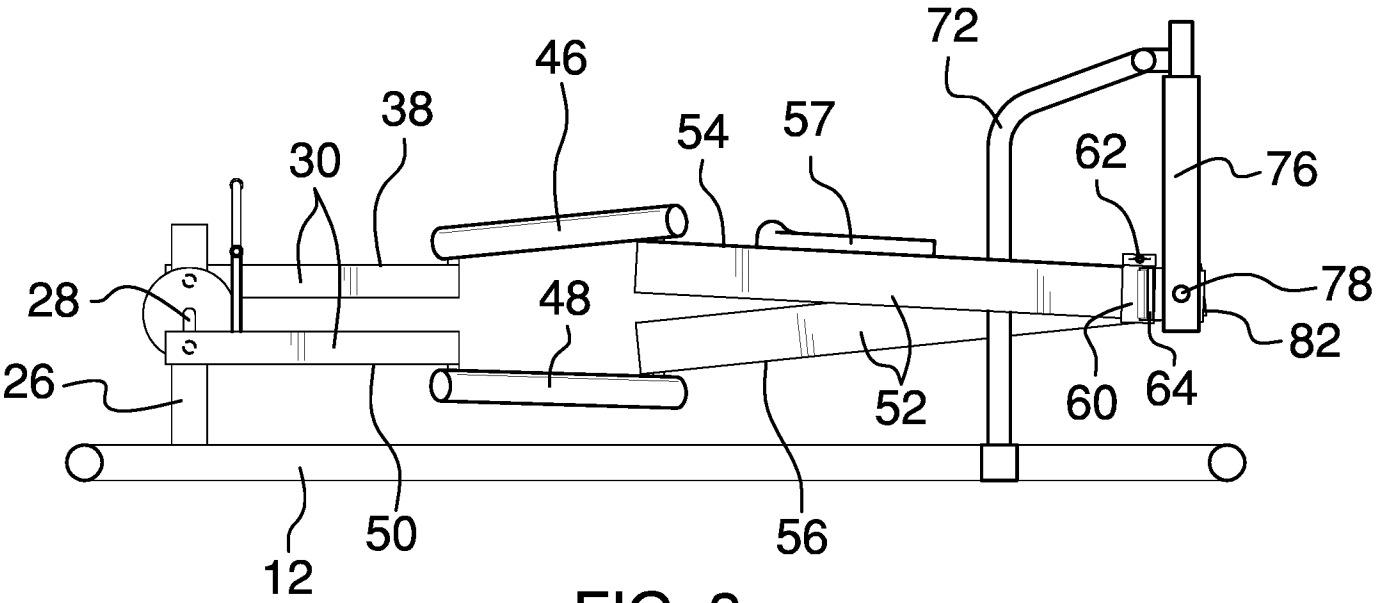
FIG. 3 is a side elevation view of an embodiment of the disclosure.
Figure 4:
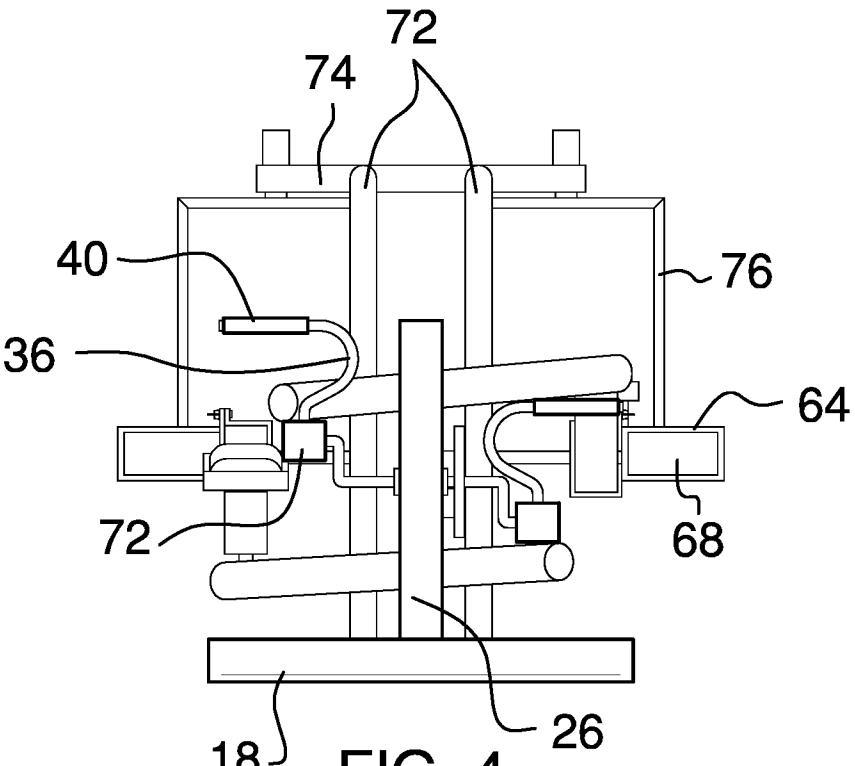
FIG. 4 is a front elevation view of an embodiment of the disclosure.
Figure 5:
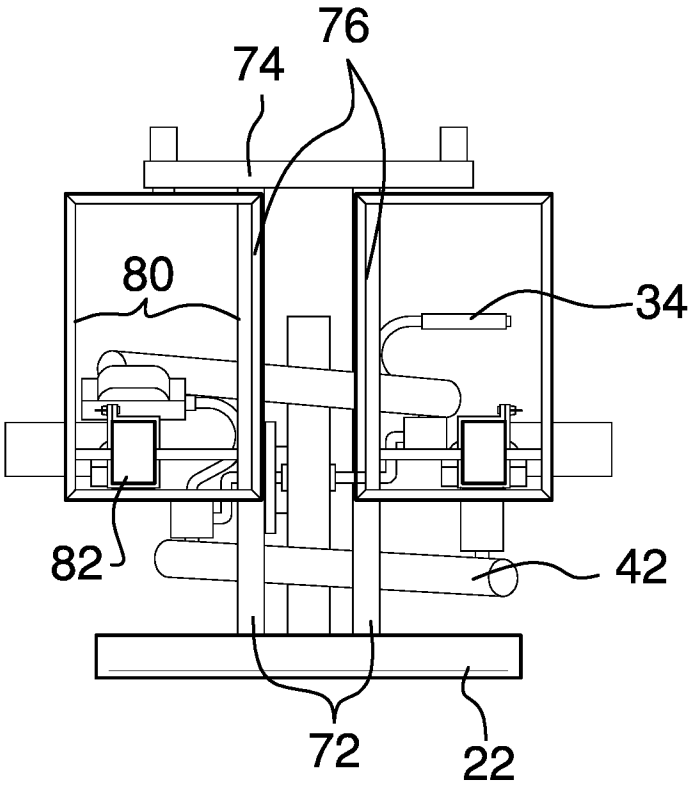
FIG. 5 is a rear elevation view of an embodiment of the disclosure.
Figure 6:
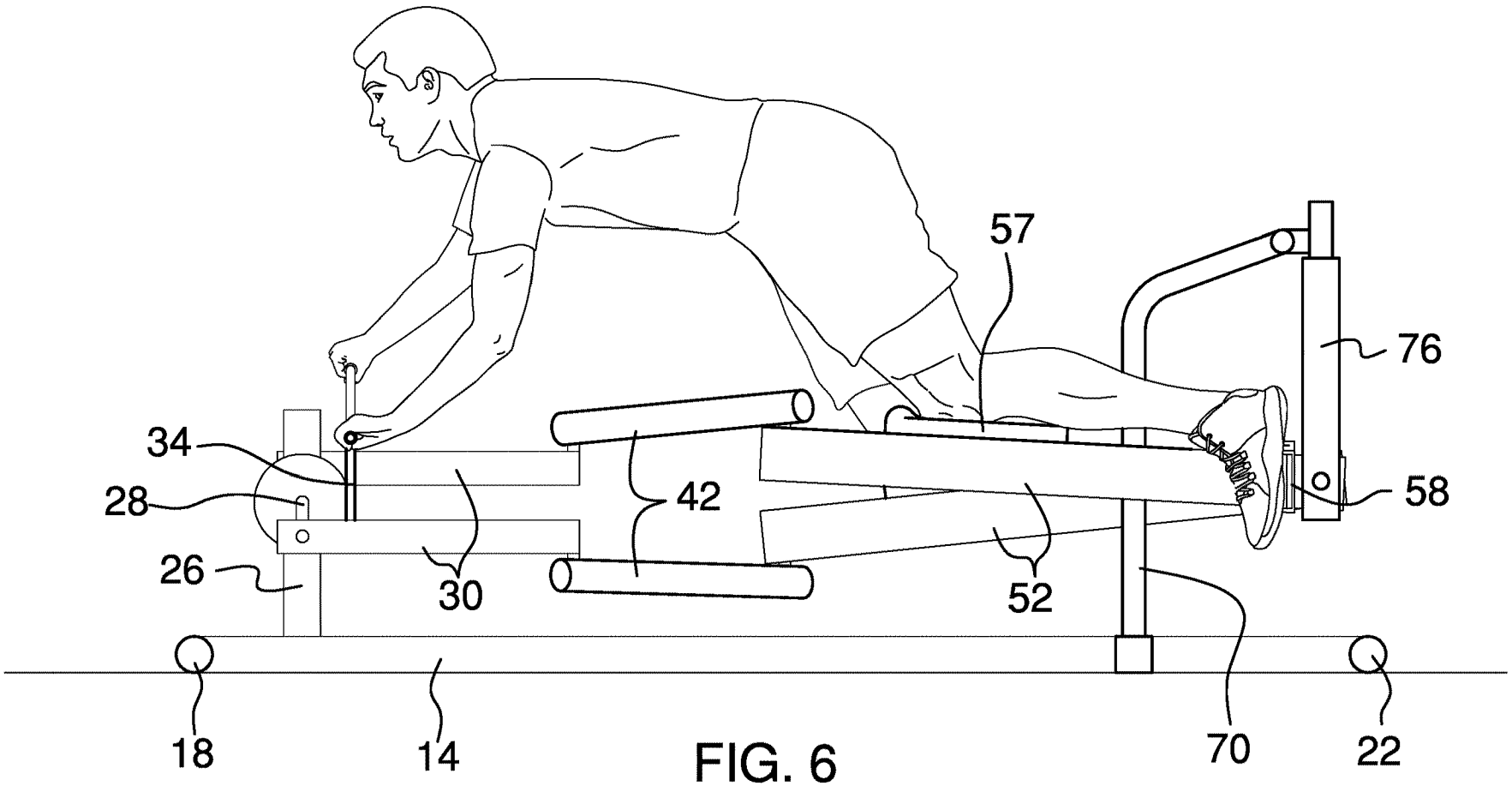
FIG. 6 is an in-use view of an embodiment of the disclosure.

A pair of leg bars 52 is coupled to the pair of crossbars 42. Each leg bar 52 is pivotably coupled to the respective crossbar 42 with the top crossbar 46 being coupled to a leg bar top side 54 of the respective leg bar and the bottom crossbar 48 being coupled to a leg bar bottom side 56 of the respective leg bar. A pair of kneepads 57 is coupled to the pair of leg bars 52. Each kneepad 57 is pivotably coupled to the leg bar top side 56 of the respective leg bar 52 and moves between a narrow position oriented parallel with the leg bar 52 and a wide position oriented perpendicularly with the leg bar 52 as shown in FIG. 2.

A pair of footrests 58 is coupled to the pair of leg bars 52. Each footrest 58 may have an attachment collar 60 slidingly coupled to the respective leg bar 52. The attachment collar 60 has a clamp 62 to selectively prevent or allow translation along the leg bar 52. Each footrest 58 has a rest portion 64 extending from the attachment collar 60 and lying perpendicularly to a leg bar outer side 66 of the respective leg bar. Each rest portion 64 may have an angled front face 68.

A leg support 70 is coupled to the base 12. The leg support 70 may have a pair of riser bars 72 extending from the central base bar 14 proximal the foot side 24 of the base and a frame bar 74 coupled to the pair of riser bars 72. The pair of riser bars 72 may extend perpendicularly before bending to form an angle between 90°-135°. A pair of support frames 76 is coupled to the leg support 70. Each support frame 76 is coupled to the frame bar 74 and oriented perpendicularly with the pair of leg bars 52. Each support frame 76 may be vertically adjustable relative the frame bar 74. A pair of leg support rods 78 is coupled to the pair of support frames 76. Each leg support rod 78 extends between a pair of vertical edges 80 of each support frame. Each leg support rod 78 extends through a leg bar distal end 82 of the respective leg bar. The leg bar distal end 82 is slidably coupled to the leg support rod 78 to allow for side-to-side translational movement of the leg bar 52 within the support frame 76.

In use, the pair of kneepads 57 is placed in the desired orientation and the pair of footrests 58 are positioned as needed. The user then mounts the apparatus 10 in an all fours position with his or her knees on the pair of kneepads 57 and feet on the pair of footrests 58 while securing the pair of handles 34. The user then moves the pair of handles 34 in a rotational motion to mimic a crawling movement.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A crawling workout apparatus comprising:

a base, the base having a central base bar and a plurality of legs;

a pedal support coupled to the base, the pedal support extending perpendicularly from the central base bar proximal a head side of the base;

a pair of crank shafts coupled to the pedal support, each crank shaft being rotatably coupled to the pedal support;

a pair of pedals coupled to the pair of crank shafts, each pedal being rotatably coupled to the respective crank shaft;

a pair of handles coupled to the pair of pedals;

a pair of crossbars coupled to the pair of pedals, each crossbar being pivotably coupled to the respective pedal, the pair of crossbars being arranged in an overlapping X-shape;

a pair of leg bars coupled to the pair of crossbars, each leg bar being pivotably coupled to the respective crossbar;

a pair of kneepads coupled to the pair of leg bars;

a pair of footrests coupled to the pair of leg bars;

a leg support coupled to the base, the leg support extending from the central base bar proximal a foot side of the base;

a pair of support frames coupled to the leg support; and a pair of leg support rods coupled to the pair of support frames, each leg support rod extending through a leg bar distal end of the respective leg bar.

2. The crawling workout apparatus of claim 1 further comprising the plurality of legs of the base including a front leg coupled perpendicularly to the central base bar at the head side of the base and a back leg coupled perpendicularly to the central base bar at the foot side of the base.

3. The crawling workout apparatus of claim 1 further comprising each handle having a handle extension extending up and out from a pedal top side of the respective pedal and a grip coupled to the handle extension.

4. The crawling workout apparatus of claim 1 further comprising the pair of crossbars including a top crossbar coupled to a pedal top side of one of the pedals and a bottom crossbar coupled to a pedal bottom side of the other pedal.

5. The crawling workout apparatus of claim 1 further comprising each kneepad being pivotably coupled to a leg bar top side of the respective leg bar, each kneepad moving between a narrow position oriented parallel with the leg bar and a wide position oriented perpendicularly with the leg bar.

6. The crawling workout apparatus of claim 1 further comprising each footrest having an attachment collar slidingly coupled to the respective leg bar, the attachment collar having a clamp to selectively prevent or allow translation along the leg bar, each footrest having a rest portion extending from the attachment collar and lying perpendicularly to a leg bar outer side of the respective leg bar.

7. The crawling workout apparatus of claim 1 further comprising the leg support having a pair of riser bars and a frame bar coupled to the pair of riser bars.

8. The crawling workout apparatus of claim 7 further comprising each support frame being coupled to the frame bar and oriented perpendicularly with the pair of leg bars, each leg support rod extending between a pair of vertical edges of each support frame.

9. The crawling workout apparatus of claim 1 further comprising the leg bar distal end being slidably coupled to the leg support rod.

10. A crawling workout apparatus comprising:

a base, the base having a central base bar and a plurality of legs, the plurality of legs of the base including a front leg coupled perpendicularly to the central base bar at a head side of the base and a back leg coupled perpendicularly to the central base bar at a foot side of the base;

a pedal support coupled to the base, the pedal support extending perpendicularly from the central base bar proximal the head side of the base;

a pair of crank shafts coupled to the pedal support, each crank shaft being rotatably coupled to the pedal support;

a pair of pedals coupled to the pair of crank shafts, each pedal being rotatably coupled to the respective crank shaft;

a pair of handles coupled to the pair of pedals, each handle having a handle extension extending up and out from a pedal top side of the respective pedal and a grip coupled to the handle extension;

a pair of crossbars coupled to the pair of pedals, each crossbar being pivotably coupled to the respective pedal, the pair of crossbars being arranged in an overlapping X-shape, the pair of crossbars including a top crossbar coupled to a pedal top side of one of the pedals and a bottom crossbar coupled to a pedal bottom side of the other pedal;

a pair of leg bars coupled to the pair of crossbars, each leg bar being pivotably coupled to the respective crossbar;

a pair of kneepads coupled to the pair of leg bars, each kneepad being pivotably coupled to a leg bar top side of the respective leg bar, each kneepad moving between a narrow position oriented parallel with the leg bar and a wide position oriented perpendicularly with the leg bar;

a pair of footrests coupled to the pair of leg bars, each footrest having an attachment collar slidingly coupled to the respective leg bar, the attachment collar having a clamp to selectively prevent or allow translation along the leg bar, each footrest having a rest portion extending from the attachment collar and lying perpendicularly to a leg bar outer side of the respective leg bar;

a leg support coupled to the base, the leg support having a pair of riser bars extending from the central base bar proximal the foot side of the base and a frame bar coupled to the pair of riser bars;

a pair of support frames coupled to the leg support, each support frame being coupled to the frame bar and oriented perpendicularly with the pair of leg bars; and a pair of leg support rods coupled to the pair of support frames, each leg support rod extending between a pair of vertical edges of each support frame, each leg support rod extending through a leg bar distal end of the respective leg bar, the leg bar distal end being slidably coupled to the leg support rod.

* * * * *